US010158170B2

(12) United States Patent
Elad et al.

(10) Patent No.: US 10,158,170 B2
(45) Date of Patent: Dec. 18, 2018

(54) TWO-DIMENSIONAL SCANNING CYLINDRICAL REFLECTOR

(71) Applicants: Danny Elad, Moshav Liman (IL); Daniel Friedman, Sleepy Hollow, NY (US); Noam Kaminski, Kiryat Tivon (IL); Ofer Markish, Nesher (IL); Alberto Valdes Garcia, Chappaqua, NY (US)

(72) Inventors: Danny Elad, Moshav Liman (IL); Daniel Friedman, Sleepy Hollow, NY (US); Noam Kaminski, Kiryat Tivon (IL); Ofer Markish, Nesher (IL); Alberto Valdes Garcia, Chappaqua, NY (US)

(73) Assignee: International Business Machines Corporation, Armonk, NY (US)

( * ) Notice: Subject to any disclaimer, the term of this patent is extended or adjusted under 35 U.S.C. 154(b) by 367 days.

(21) Appl. No.: 15/005,018

(22) Filed: Jan. 25, 2016

(65) Prior Publication Data

US 2017/0214145 A1 Jul. 27, 2017

(51) Int. Cl.
*H01Q 15/14* (2006.01)
*H01Q 3/18* (2006.01)
(Continued)

(52) U.S. Cl.
CPC ..... *H01Q 3/18* (2013.01); *H01Q 3/12* (2013.01); *H01Q 3/16* (2013.01); *H01Q 3/2658* (2013.01); *H01Q 19/175* (2013.01)

(58) Field of Classification Search
CPC ..... H01Q 15/14; H01Q 3/12; H01Q 3/16; H01Q 3/18; H01Q 3/2658; H01Q 19/175
(Continued)

(56) References Cited

U.S. PATENT DOCUMENTS 4,439,773 A * 3/1984 Chu ..... H01Q 3/2658 343/778
5,202,700 A * 4/1993 Miller ..... H01Q 19/17 343/840

(Continued)

OTHER PUBLICATIONS

Vincent Mrstik et al., "Scanning capabilities of large parabolic cylinder reflector antennas with phased-array feeds", General Research Corporation, Santa Barbara, CA, USA; Smith, P.G., Antennas and Propagation, IEEE Transactions on (vol. 29 , Issue: 3) May 1981.

(Continued)

*Primary Examiner* — Dameon E Levi
*Assistant Examiner* — Ab Salam Alkassim, Jr.

(57) ABSTRACT

A parabolic cylindrical reflector antenna that comprises two or more antenna feeds each directed towards a parabolic cylindrical reflector, wherein the antenna feeds are positioned in one or more line-arrays parallel to a focal line of the parabolic cylindrical reflector, and the line-array is substantially centered opposing the reflector. The antenna comprises a controller configured to scan along a straight edge of the reflector by electronically adjusting a phase of each of the antenna feeds, thereby changing the incident angle of an energy beam relative to the reflector. The controller is configured to scan along a curved edge of the reflector by moving, using a mechanical positioning mechanism, the antenna feeds in a direction parallel to a directrix of the reflector while maintaining the positioning or by electronically selecting one of two or more parallel line-arrays.

13 Claims, 5 Drawing Sheets

(51) Int. Cl.

| | |
|---|---|
| ***H01Q 3/12*** | (2006.01) |
| ***H01Q 3/16*** | (2006.01) |
| ***H01Q 3/26*** | (2006.01) |
| ***H01Q 19/17*** | (2006.01) |

(58) Field of Classification Search
USPC ..... 343/840
See application file for complete search history.

(56) References Cited

U.S. PATENT DOCUMENTS

| | | | | |
|---|---|---|---|---|
| 5,642,122 | A | 6/1997 | Lockie et al. | |
| 6,188,913 | B1 * | 2/2001 | Fukagawa | H01Q 3/2605 342/359 |
| 8,248,298 | B2 | 8/2012 | Lalezari | |
| 8,284,102 | B2 | 10/2012 | Hayes et al. | |
| 8,354,956 | B2 | 1/2013 | Matyas et al. | |
| 8,604,989 | B1 | 12/2013 | Olsen | |
| 9,991,948 | B2 * | 6/2018 | Ozaki | H01Q 3/18 |
| 2010/0238082 | A1 * | 9/2010 | Kits van Heyningen | H01Q 3/08 343/761 |
| 2014/0266870 | A1 | 9/2014 | Koduru et al. | |
| 2015/0138018 | A1 * | 5/2015 | Yamamoto | H01Q 3/18 342/372 |
| 2017/0207528 | A1 * | 7/2017 | Lundstedt | H01Q 3/18 |

OTHER PUBLICATIONS

"Focuser-based hybrid antennas for one-dimensional beam steering", Phased Array Systems and Technology, 2000. Proceedings. 2000 IEEE International Conference on Date of Conference: 2000, pp. 411-414.

* cited by examiner

TWO-DIMENSIONAL SCANNING CYLINDRICAL REFLECTOR

BACKGROUND

The invention relates to the field of antennas.

Cylindrical reflector antennas are antennas with a reflector curved in one direction, such as having a parabolic cross section, and flat in the other direction. The reflector has a focal line parallel to the cylindrical axis. An antenna feed may be located along the focal line, centered relative to the reflector. The antenna feed may project electromagnetic radiation towards the reflector, which reflects a beam from the antenna feed and focusses a three-dimensional (3D) radiation beam along the curved direction after it is reflected. The antenna feed may be a dipole antenna located along the focal line. The term antenna feed means the physical antenna components that feed the electromagnetic radiation to the antenna reflector, and/or receive the incoming electromagnetic radiation reflected from the antenna reflector surface. The antenna feeds are generally directed towards the reflector and away from the transmission direction. Cylindrical parabolic antennas may radiate a 3D fan-shaped beam, narrow in the curved direction, and wide in the un-curved or straight direction.

For example, the electromagnetic radiation reaching the cylindrical reflector is reflected towards the feed and focused in a plane perpendicular to the cylindrical axis and is spread out along a plane defined by the cylindrical axis and vertex line. The term vertex line refers to the collection of vertex points of cross sectional parabolas defining the parabolic cylindrical reflector. The term tangent plane is a plane tangent to the parabolas defining the parabolic cylinder reflector and passing through the vertex line. The curved ends of the reflector are sometimes capped by flat plates, to prevent radiation out the ends, and this may be called a pillbox antenna.

The foregoing examples of the related art and limitations related therewith are intended to be illustrative and not exclusive. Other limitations of the related art will become apparent to those of skill in the art upon a reading of the specification and a study of the figures.

SUMMARY

The following embodiments and aspects thereof are described and illustrated in conjunction with systems, tools and methods which are meant to be exemplary and illustrative, not limiting in scope.

There is provided, in accordance with an embodiment, a parabolic cylindrical reflector antenna. The antenna comprises a parabolic cylindrical reflector. The antenna comprises two or more antenna feeds each directed towards the parabolic cylindrical reflector, wherein the antenna feeds are positioned in one or more line-arrays parallel to a focal line of the parabolic cylindrical reflector, and wherein the line-array(s) is substantially centered opposing the parabolic cylindrical reflector. The antenna comprises a controller configured to scan along a straight edge of the parabolic cylindrical reflector by electronically adjusting a phase of each of the antenna feeds, thereby changing the incident angle of an energy beam relative to the vertex line of the parabolic cylindrical reflector. The controller is configured to scan along a curved edge of the parabolic cylindrical reflector by moving, using a mechanical positioning mechanism, the antenna feeds in a direction parallel to a directrix of the parabolic cylindrical reflector while maintaining the orientation or by electronically selecting one of the line-array(s), wherein the selecting comprises selecting from two or more parallel linear arrays.

Optionally, the parabolic cylindrical reflector antenna further comprises a mechanical positioning mechanism.

Optionally, the heat produced from the one or more line-array is transferred to the mechanical positioning mechanism to facilitate the moving of the antenna feeds.

Optionally, the parabolic cylindrical reflector antenna further comprises a rotation mechanism attached to the one or more line-array, adapted to rotate the one or more line-array relative to the focal line, and wherein the scan along a straight edge of the parabolic cylindrical reflector is further performed by a rotation of the one or more line-array.

Optionally, the heat produced from the one or more line-array is transferred to the rotation mechanism.

Optionally, the moving and the rotating are performed to characterize a surface of the parabolic cylindrical reflector.

Optionally, the parabolic cylindrical reflector antenna comprises a transmitter and divider network connected to said plurality of antenna feeds.

Optionally, the parabolic cylindrical reflector antenna further comprises one or more hardware processor.

There is provided, in accordance with an embodiment, a method for two dimensional scanning with a parabolic cylindrical reflector antenna. The method comprises using a controller to scan along a straight edge of a parabolic cylindrical reflector by electronically adjusting a phase of each of two or more antenna feeds, thereby changing the incident angle of an energy beam relative to the vertex line of the parabolic cylindrical reflector, wherein the antenna feeds are positioned in a line-array parallel to a focal line of the parabolic cylindrical reflector, wherein the line-array is substantially centered opposing the parabolic cylindrical reflector. The method comprises using a controller to scan along a curved edge of the parabolic cylindrical reflector by moving the antenna feeds in a direction parallel to a directrix of the parabolic cylindrical reflector while maintaining the positioning, or electronically selecting one of a parallel line-arrays, and wherein each of the parallel line-arrays maintains the positioning. The method comprises using a controller to output scanned data.

Optionally, the moving is performed by a mechanical positioning mechanism.

Optionally, the method further comprises transferring a heat produced from the one or more line-array to the mechanical positioning mechanism.

Optionally, the scan along a straight edge of a parabolic cylindrical reflector is performed by rotating the one or more line-array relative to the focal line using a rotation mechanism attached to the one or more line-array.

Optionally, the heat produced from the one or more line-array is transferred to the rotation mechanism.

Optionally, the moving and the rotating are performed to characterize a surface of the parabolic cylindrical reflector.

Optionally, the method further comprises a transmitter and divider network connected to said plurality of antenna feeds.

Optionally, the controller comprises one or more hardware processors.

There is provided, in accordance with an embodiment, a computerized device comprising one or more hardware processor configured to scan along a straight edge of a parabolic cylindrical reflector by electronically adjusting a phase of each of two or more antenna feeds, thereby changing the incident angle of an energy beam relative to the vertex line of the parabolic cylindrical reflector, wherein the antenna feeds are positioned in a line-array parallel to a focal line of the parabolic cylindrical reflector, wherein the line-array is substantially centered opposing the parabolic cylindrical reflector. The hardware processor(s) are configured to scan along a curved edge of the parabolic cylindrical reflector by moving the antenna feeds in a direction parallel to a directrix of the parabolic cylindrical reflector while maintaining the positioning, or electronically selecting one of two or more parallel line-arrays, and wherein each of the parallel line-arrays maintains the positioning. The hardware processor(s) are configured to output scanned data.

Optionally, the moving is performed by a mechanical positioning mechanism.

Optionally, the computerized device further comprises transferring a heat produced from the one or more line-array to the mechanical positioning mechanism.

Optionally, the scan along a straight edge of a parabolic cylindrical reflector is performed by rotating the one or more line-array relative to the focal line using a rotation mechanism attached to the one or more line-array.

Optionally, the heat produced from the one or more line-array is transferred to the rotation mechanism.

Optionally, the moving and the rotating are performed to characterize a surface of the parabolic cylindrical reflector.

Optionally, the computerized device comprises a transmitter and divider network connected to said plurality of antenna feeds.

In addition to the exemplary aspects and embodiments described above, further aspects and embodiments will become apparent by reference to the figures and by study of the following detailed description.

BRIEF DESCRIPTION OF THE FIGURES

Exemplary embodiments are illustrated in referenced figures. Dimensions of components and features shown in the figures are generally chosen for convenience and clarity of presentation and are not necessarily shown to scale. The figures are listed below.

DETAILED DESCRIPTION

Provided herein are systems and methods for a scanning antenna using a parabolic cylindrical reflector and one or more line-array antenna feeds parallel to the focal line. Antenna beam scanning may be performed along the vertex line of the reflector, such as parallel to the straight edge of the reflector, by using a controller to electronically adjust the phase of each array element so that the electromagnetic radiation beam reaches the reflector at an acute incident angle relative to the vertex line. The beam is reflected back at this incident angle. Scanning may be performed in the plane perpendicular to the focal line, such as along the curved direction of the reflector, by using a controller to either: (a) change the physical positioning of the line-array so that it moves away from the focal line but stays parallel to the focal line at the same distance from a tangent plane of the parabolic cylindrical reflector; or (b) electronically selecting one of several parallel line-arrays positioned in the focal plane parallel to the focal line. The focal plane means a plane through the focal line parallel to the tangent plane.

Optionally, the antenna is used for an airborne application and the heat generated by the transceivers during their operation is transferred to a mechanical displacement mechanism to increase the temperature of a motor and/or gear above the ambient temperature.

Optionally, the antenna feed is rotated relative to the focal line to increase the scan capabilities along the straight direction of the reflector.

Optionally, the antenna feed is displaced and/or rotated to fully characterize a parabolic cylindrical reflector in a short time.

Optionally, the antenna comprises a transmitter and divider network connected to said plurality of antenna feeds. For example, said linear array of antenna feeds is a fixed linear array.

Optionally, two or more antennas as described herein are incorporated into an antenna system that scans several beams at once, one for each antenna.

Figure 1:
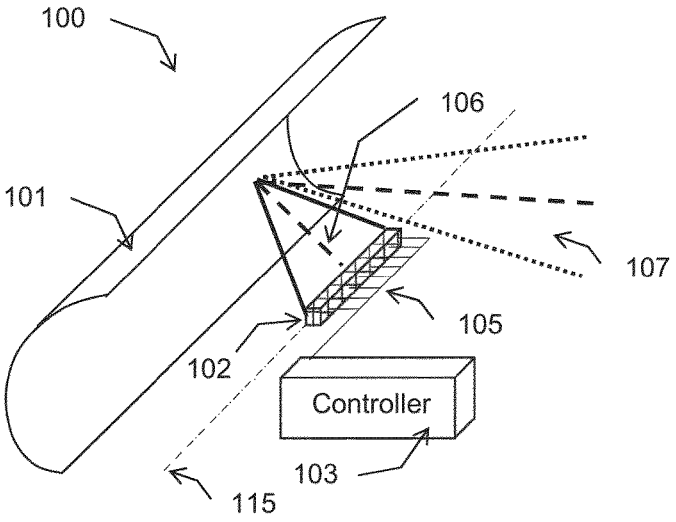
FIG. 1 is a schematic illustration of a perspective-sectional view of a parabolic cylindrical antenna electronically scanning along the vertex line.

Reference is now made to FIG. 1, which is a schematic illustration of a parabolic cylindrical antenna 100 electronically scanning along the vertex line. Antenna 100 comprises a parabolic cylindrical reflector 101, and a linear phased-array antenna feed 102 configured in a line of phased array elements. As used herein, the term "feed" means a linear phased-array antenna feed. The linear feed is aligned with a focal line 115 of the parabolic cylindrical reflector 101. A controller 103 is electronically connected to each element of the phased array feed 102 with electrical connections 105. By adjusting the electrical phase of a periodic signal to each element of the phased array 102, the controller can steer the emitted electromagnetic radiation beam 106, which in turn steers the reflected electromagnetic radiation beam 107 according to the incident angle of the reflection.

Figure 2:
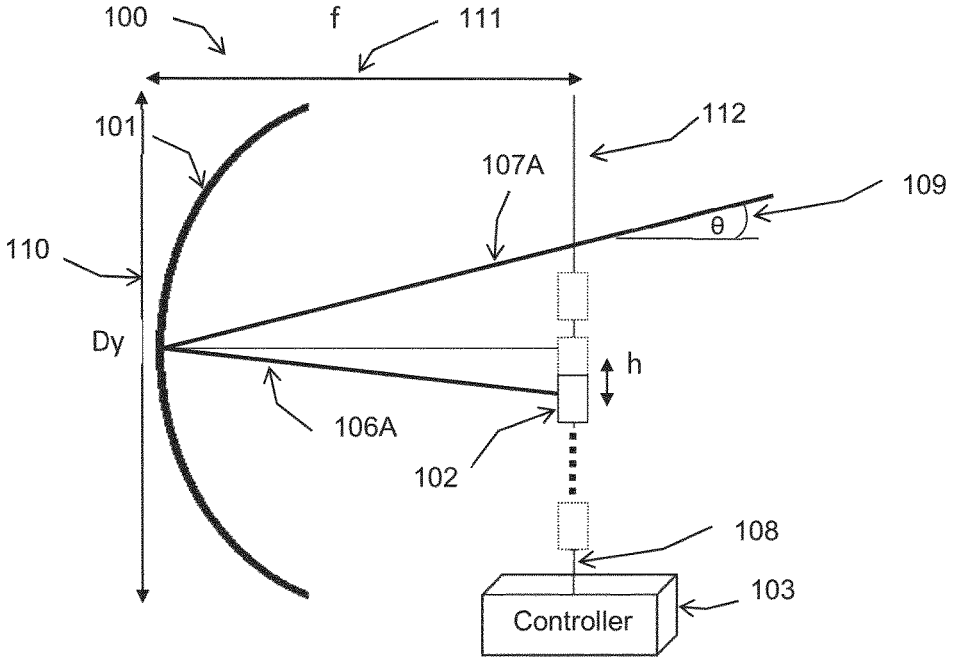
FIG. 2 is a schematic illustration of a cross-sectional view of a parabolic cylindrical antenna scanning by mechanically moving a line-array antenna feed.

Reference is now made to FIG. 2, which is cross-sectional schematic illustration of a parabolic cylindrical antenna 100A scanning by mechanically moving a line-array antenna feed. Antenna 100A comprises a parabolic cylindrical reflector 101 and a linear feed 102. The parabolic cylindrical reflector 101 has a cross-sectional shape defined by a parabolic function, and the curved direction 110, denoted Dy, is scanned by moving the linear antenna feed 102. The parabolic cylindrical reflector 101 has a focal plane 112 that is a plane parallel to the tangent plane 110, and at a focal length 111, denoted f, distance from the tangent plane 110. Controller 103 controls to a mechanical device 108 that changes the position, denoted h, of the feed 102 in the focal plane 112, maintaining the linear feed 102 parallel to the focal line of the reflector 101. This controls the direction of the electromagnetic radiation beam 106A relative to the reflector 101, and in turn the reflected electromagnetic radiation beam 107A according to an incident angle 109.

Figure 3:
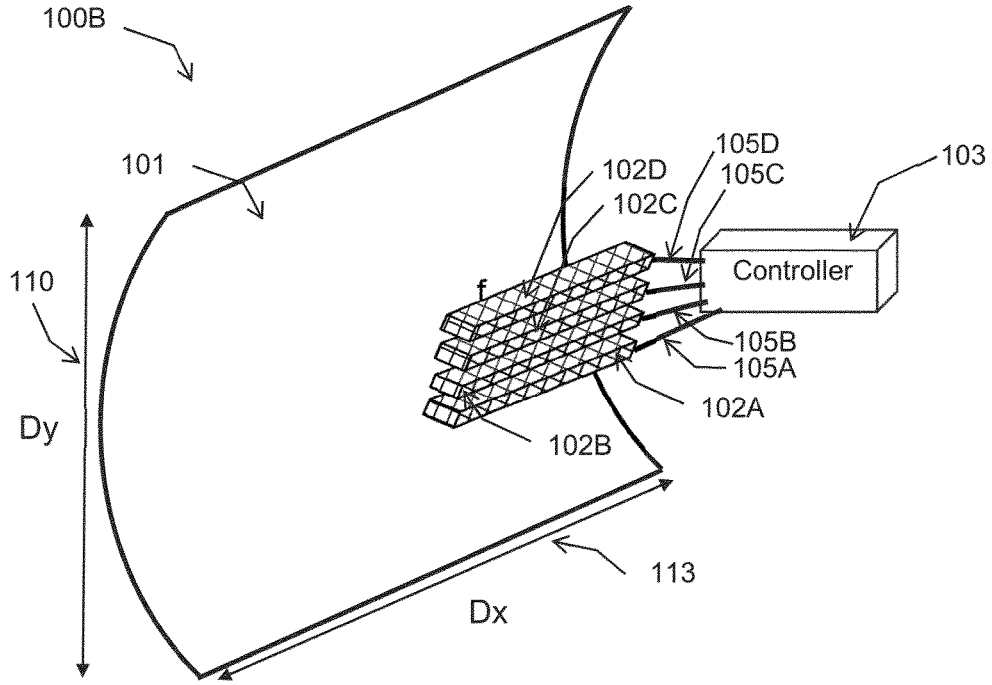
FIG. 3 is a schematic illustration of a parabolic cylindrical antenna with multiple line-array antenna feeds for electronically scanning.

Reference is now made to FIG. 3, which is a schematic illustration of a parabolic cylindrical antenna 100B with multiple line-array antenna feeds for electronically scanning. According to aspects of this embodiment, two or more linear phased array antenna feeds, such as 102A, 102B, 102C, 102D, and the like, are positioned in the focal plane parallel to the straight edge 113, denoted Dx, of parabolic cylindrical reflector 101. The focal plane (not shown) is also parallel to the directrix 110A, denoted Dy, of the curved edge of the parabolic cylindrical reflector 101. The focal plane is at a distance of a focal length, denoted f, from the vertex of the parabolic function defining the cross section of the parabolic cylindrical reflector 101. Controller 103A comprises a set of control lines, as at 105A, 105B, 105C, 105D, and the like, one for each linear phased array feed, such as 102A, 102B, 102C, 102D, and the like. The controller may steer an electromagnetic radiation beam (not shown) reflected from the parabolic cylindrical reflector 101 be sending a signal to one of the linear feed arrays using the corresponding set of control lines.

Figure 4:
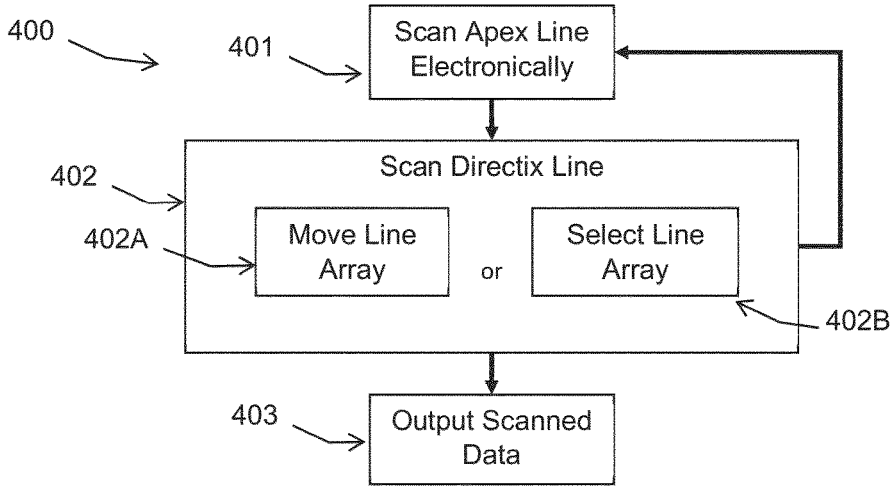
FIG. 4 is a flowchart of method for scanning in two dimensions using a parabolic cylindrical antenna.

Reference is now made to FIG. 4, which is a flowchart of method 400 for scanning in two directions using a parabolic cylindrical antenna. Method 400 comprises an action of scanning 401 a vertex line electronically, such as by changing the phase of each linear array element and thereby changing the incident angle of the electromagnetic radiation beam relative to reflector 101. Method 400 comprises an action of scanning 402 a vertex line electronically, such as by either mechanically moving 402A a linear phased-array antenna feed 102 or electronically selecting 402B one of several linear phased-array antenna feeds 102A, 102B, 102C, 102D, or the like. For example, linear phased-array antenna feed 102 is mechanically displaced using a linear actuator, a screw drive, a hydraulic linear actuator, and/or the like. For example, a linear phased-array antenna feed may be selected by operating a mechanical multiplexer, an electronic multiplexer, a series of field effect transistors, and the like. Scanned data is outputted 403 to an electronic display system, such as a computerized system, and analog display system, and the like, for further processing and/or presentation to a user.

Figure 5:
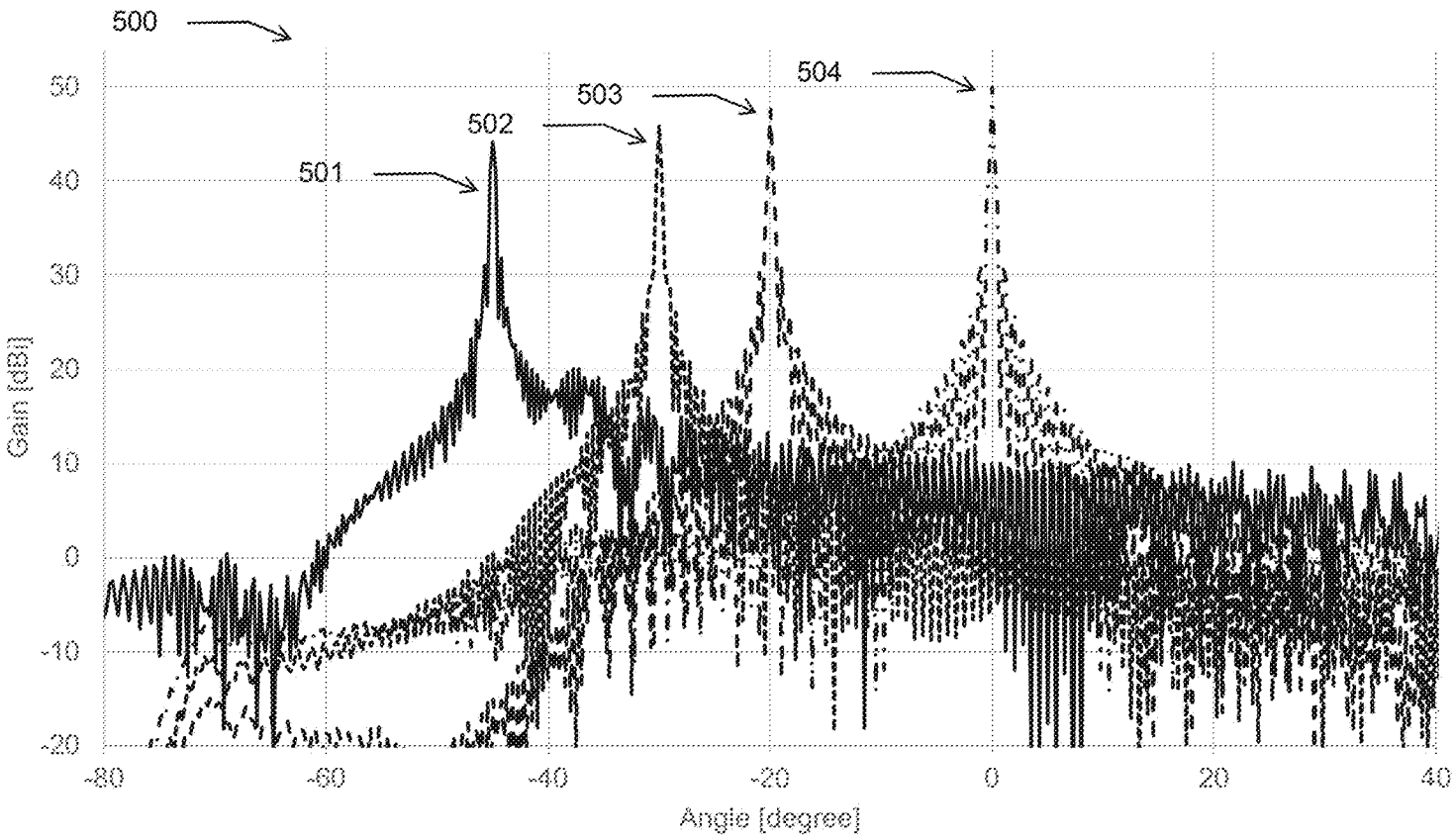
FIG. 5 is a graph of gain versus angle for scanning electronically along the straight dimension of a parabolic cylindrical antenna.

Reference is now made to FIG. 5, which is a graph 500 of gain versus angle for scanning electronically along the straight direction of a parabolic cylindrical antenna. Graph 500 shows the antenna gain versus angle along a straight edge of parabolic cylindrical reflector having a straight length of 260 wavelengths, a curved length of 65 wavelengths, an aperture of 0.9, using a linear feed array of 256 elements, and scanning electronically along the straight direction. Line 501 shows the gain versus straight edge angle for a beam with a 45-degree incident angle. Line 501 shows the gain versus straight edge angle for a beam with a 30-degree incident angle. Line 501 shows the gain versus straight edge angle for a beam with a 20-degree incident angle. Line 504 shows the gain versus straight edge angle for a beam with no incident angle.

Figure 6:
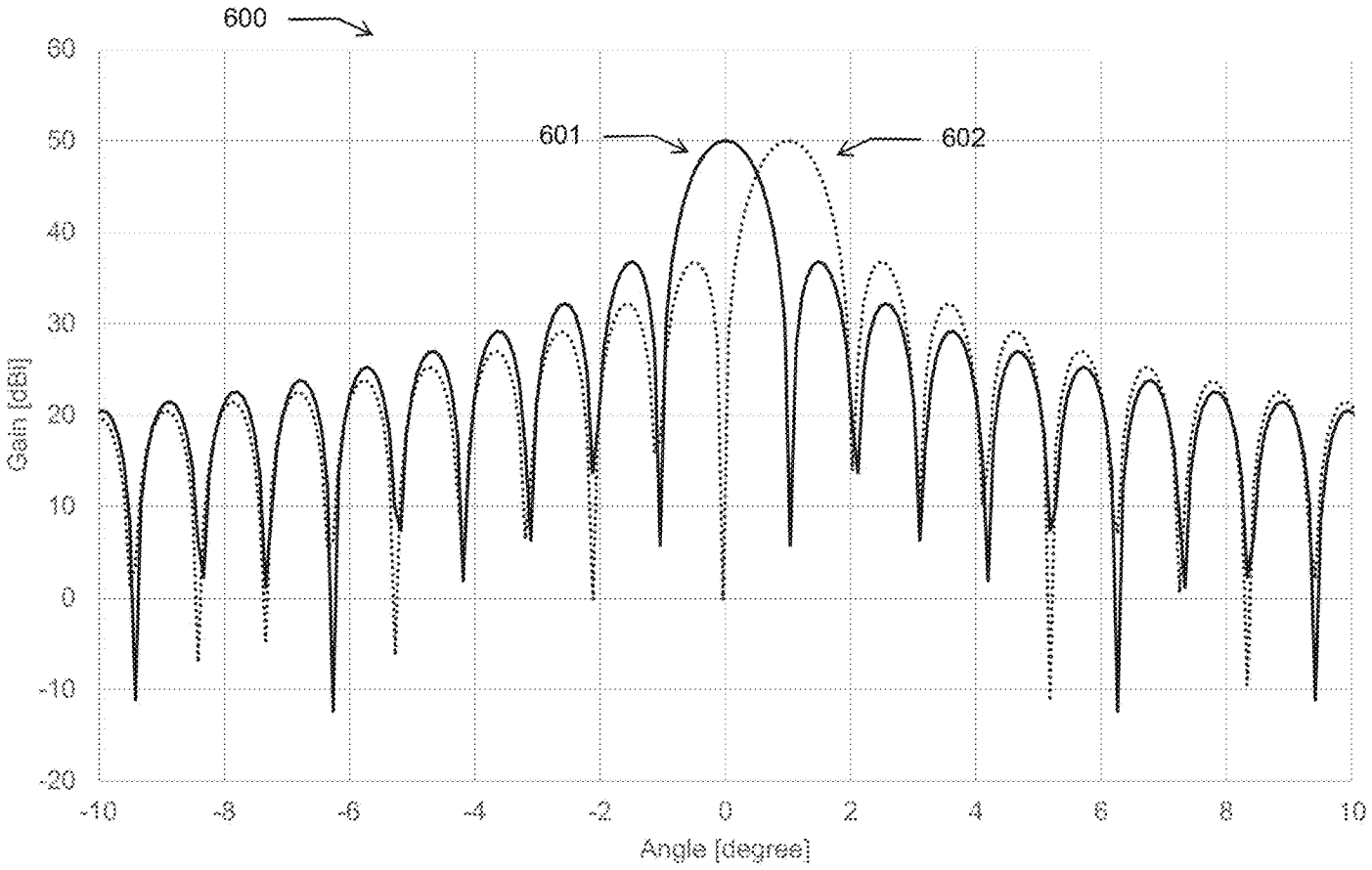
FIG. 6 is a graph of gain versus angle for scanning by mechanically moving an array feed of a parabolic cylindrical antenna.

Reference is now made to FIG. 6, which is a graph 600 of gain versus angle for scanning by mechanically moving an array feed of a parabolic cylindrical antenna. Graph 600 shows the gain versus angle along a straight edge of parabolic cylindrical reflector having a straight length of 260 wavelengths, a curved length of 65 wavelengths, an aperture of 0.9 wavelengths, using linear feed array 102 of 256 elements, and scanning be mechanically moving linear feed array 102. Line 601 shows the gain versus straight edge angle for a linear array centered at focal line 115. Line 602 shows the gain versus straight edge angle for a linear array at an offset from focal line 115 to produce a scan at 1-degree angle.

Rotation of the antenna feed may allow increasing the scan range along the straight direction of the antenna, using antenna feed to quickly characterize the surface of the reflector, and/or the like. For example, the linear array of antenna feeds are connected to a transmitter and a dividing network, thereby making the linear array a fixed linear array, such that the controller may not change the phase of each element of the array, and by rotating and moving the feed the reflector surface can be scanned for deformities, gain, surface quality, and/or the like.

Figure 7A:
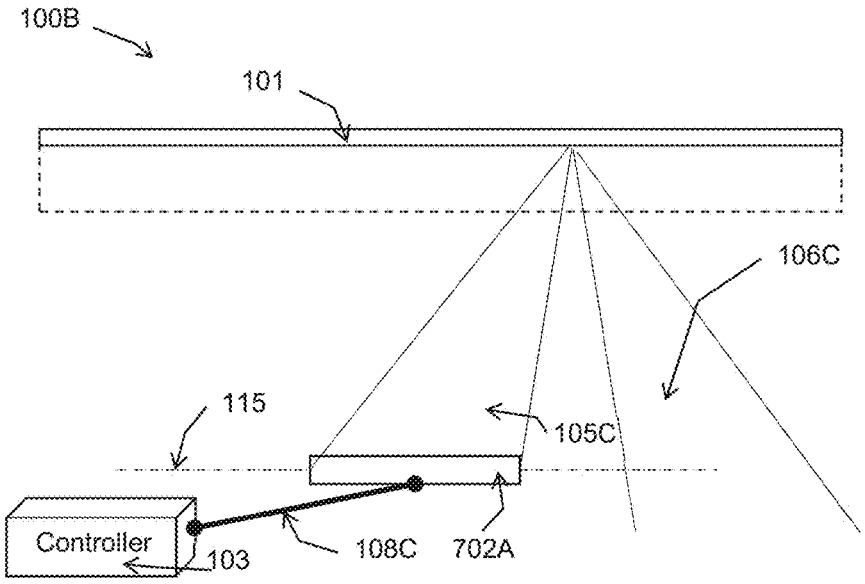
FIG. 7A is a first cross-sectional schematic illustration of a parabolic cylindrical reflector antenna scanning by mechanically rotating a line-array antenna feed.
Figure 7B:
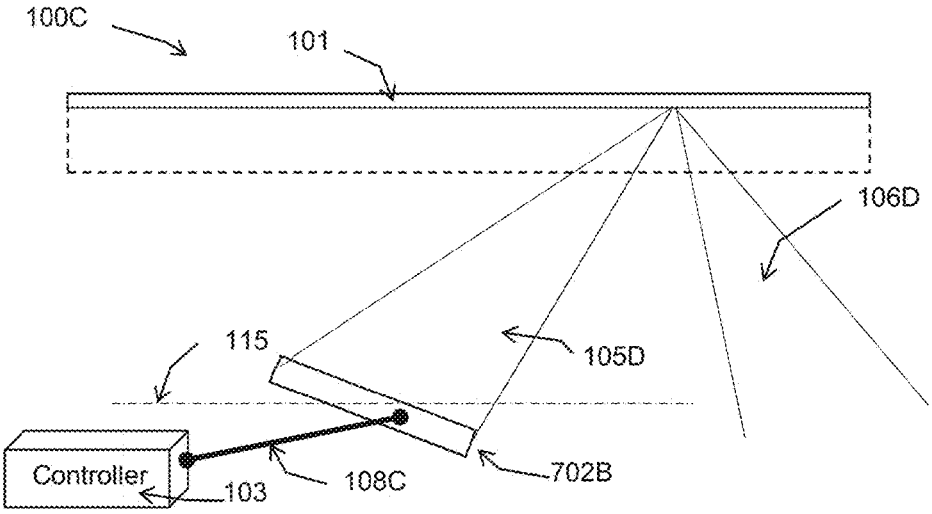
FIG. 7B is a second cross-sectional schematic illustration of a parabolic cylindrical reflector antenna scanning by mechanically rotating a line-array antenna feed.

Reference is now made to FIG. 7A, which is a first cross-sectional schematic illustration of a parabolic cylindrical reflector antenna 100B scanning by mechanically rotating a line-array antenna feed 702A. Line-array antenna feed 702A is rotated using an actuator 108C according to commands set from a controller 103. When feed 702A is parallel to focal line 115, a beam 105C from feed 702A is reflected from reflector 101, resulting in a reflected beam 106C. Reference is now made to FIG. 7B, which is a second cross-sectional schematic illustration of a parabolic cylindrical reflector antenna 100C scanning by mechanically rotating a line-array antenna feed 702B. Line-array antenna feed 702B is rotated using an actuator 108C according to commands set from a controller 103 to be at an angle relative to focal line 115. A beam 105D from feed 702B is reflected from reflector 101, resulting in a reflected beam 106D at an increased incident angle, such as an angle greater than the maximum angle capable by electronically steering the linear array feed using the signal phases for each phased array element.

Aspects of the present invention are described herein with reference to flowchart illustrations and/or block diagrams of methods, apparatus (systems), and the like according to embodiments of the invention. It will be understood that each block of the flowchart illustrations and/or block diagrams, and combinations of blocks in the flowchart illustrations and/or block diagrams, can be implemented by different embodiments.

The flowchart and block diagrams in the Figures illustrate the architecture, functionality, and operation of possible implementations of systems, methods, and the like according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The present invention may comprise a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A parabolic cylindrical reflector antenna comprising:

a mechanical positioning mechanism;

a parabolic cylindrical reflector;

a plurality of antenna feeds each directed towards said parabolic cylindrical reflector, wherein said plurality of antenna feeds are positioned in at least one line-array parallel to a focal line of said parabolic cylindrical reflector, and wherein said at least one line-array is substantially centered opposing said parabolic cylindrical reflector; and a controller configured to:

scan along a straight edge of said parabolic cylindrical reflector by electronically adjusting a phase of each of said plurality of antenna feeds, thereby changing the incident angle of an energy beam relative to the vertex line of said parabolic cylindrical reflector, and scan along a curved edge of said parabolic cylindrical reflector by at least one of:

(a) moving, using said mechanical positioning mechanism, said plurality of antenna feeds in a direction parallel to a directrix of said parabolic cylindrical reflector while maintaining said positioning, wherein heat produced by said at least one line-array is transferred to said mechanical positioning mechanism to facilitate said moving of said plurality of antenna feeds; and (b) electronically selecting one of said at least one line-array, wherein said selecting comprises selecting from two or more parallel linear arrays.

2. The parabolic cylindrical reflector antenna of claim 1, further comprising a rotation mechanism attached to said at least one line-array, adapted to rotate said at least one line-array relative to said focal line, and wherein said scan along a straight edge of said parabolic cylindrical reflector is further performed by a rotation of said at least one line-array.

3. The parabolic cylindrical reflector antenna of claim 2, wherein heat produced from said at least one line-array is transferred to said rotation mechanism.

4. The parabolic cylindrical reflector antenna of claim 1, further comprising a transmitter and a dividing network both connected to said plurality of antenna feeds.

5. The parabolic cylindrical reflector antenna of claim 1, wherein said controller comprises at least one hardware processor.

6. A method for two dimensional scanning with a parabolic cylindrical reflector antenna, comprising using a controller to:

scan along a straight edge of a parabolic cylindrical reflector by electronically adjusting a phase of each of a plurality of antenna feeds, thereby changing the incident angle of an energy beam relative to the vertex line of said parabolic cylindrical reflector, wherein said plurality of antenna feeds are positioned in a line-array parallel to a focal line of said parabolic cylindrical reflector, wherein said line-array is substantially centered opposing said parabolic cylindrical reflector;

scan along a curved edge of said parabolic cylindrical reflector by at least one of:

(a) moving said plurality of antenna feeds, using a mechanical positioning mechanism, in a direction parallel to a directrix of said parabolic cylindrical reflector while maintaining said positioning, and transferring heat produced by said at least one line-array to said mechanical positioning mechanism, and (b) electronically selecting one of a plurality of parallel line-arrays, and wherein each of said plurality of parallel line-arrays maintains said positioning; and output scanned data.

7. The method of claim 6, wherein said scan along a straight edge of a parabolic cylindrical reflector is performed by rotating said at least one line-array relative to said focal line using a rotation mechanism attached to said at least one line-array.

8. The method of claim 7, wherein a heat produced from said at least one line-array is transferred to said rotation mechanism.

9. The method of claim 6, further comprising a transmitter and a dividing network both connected to said plurality of antenna feeds.

10. The method of claim 6, wherein said controller comprises at least one hardware processor.

11. A parabolic cylindrical reflector antenna comprising:

a parabolic cylindrical reflector;

a plurality of antenna feeds each directed towards said parabolic cylindrical reflector, wherein said plurality of antenna feeds are positioned in at least one line-array parallel to a focal line of said parabolic cylindrical reflector, and wherein said at least one line-array is substantially centered opposing said parabolic cylindrical reflector;

a rotation mechanism attached to said at least one line-array, adapted to rotate said at least one line-array relative to said focal line, wherein heat produced by said at least one line-array is transferred to said rotation mechanism; and a controller configured to:

scan along a straight edge of said parabolic cylindrical reflector by: (i) electronically adjusting a phase of each of said plurality of antenna feeds, and (ii) rotating said at least one line-array using said rotation mechanism, thereby changing the incident angle of an energy beam relative to the vertex line of said parabolic cylindrical reflector, and scan along a curved edge of said parabolic cylindrical reflector by at least one of:

(a) moving, using a mechanical positioning mechanism, said plurality of antenna feeds in a direction parallel to a directrix of said parabolic cylindrical reflector while maintaining said positioning; and (b) electronically selecting one of said at least one line-array, wherein said selecting comprises selecting from two or more parallel linear arrays.

12. The parabolic cylindrical reflector antenna of claim 11, further comprising a transmitter and divider network connected to said plurality of antenna feeds.

13. The parabolic cylindrical reflector antenna of claim 11, wherein said controller comprises at least one hardware processor.

* * * * *